United States Patent [19]

Thevenin et al.

[11] Patent Number: 4,656,794

[45] Date of Patent: Apr. 14, 1987

[54] DEVICE FOR PROVIDING DOUBLE COVERINGS OR CLADDINGS, SUPPORT PIECES, SUPPORTS AND PLIERS FOR PUTTING INTO EFFECT SAID DEVICE

[76] Inventors: Patrick D. Thevenin; Bernard C. Gissinger; Stéphane J. Thevenin, all of 0880 Monthermé, France

[21] Appl. No.: 579,719

[22] Filed: Feb. 13, 1984

[30] Foreign Application Priority Data

Mar. 11, 1983 [FR] France ..... 83 04029

[51] Int. Cl.[4] ..... E04B 7/00

[52] U.S. Cl. ..... 52/22; 52/544; 52/689; 52/715

[58] Field of Search ..... 52/394, 395, 478, 519, 52/520, 543, 544, 545, 712–715, 720, 722–740, 480, 489, 677, 689, 775, 22, 687, 688

[56] References Cited

U.S. PATENT DOCUMENTS

| | | | |
|---|---|---|---|
| 2,704,868 | 3/1955 | Danielson | 52/715 |
| 2,841,255 | 7/1958 | Kemp | 52/395 |
| 2,877,875 | 3/1959 | Bolt | 52/713 |
| 2,919,572 | 1/1960 | Salzi | 52/712 |
| 3,094,745 | 6/1963 | Stout | 52/480 |
| 3,103,263 | 9/1963 | Leeser | 52/715 |
| 3,393,488 | 7/1968 | Schneller | 52/714 |
| 3,871,150 | 3/1975 | Murray et al. | 52/779 |
| 4,141,191 | 2/1979 | Aarons | 52/715 |
| 4,432,182 | 2/1984 | Addie et al. | 52/480 |
| 4,543,760 | 10/1985 | Barker et al. | 52/544 |

FOREIGN PATENT DOCUMENTS

| | | | |
|---|---|---|---|
| 627463 | 1/1963 | Belgium | 52/726 |
| 2509350 | 9/1975 | Fed. Rep. of Germany | 52/489 |
| 2547002 | 5/1976 | Fed. Rep. of Germany | 52/714 |
| 2532607 | 1/1977 | Fed. Rep. of Germany | 52/712 |
| 693379 | 11/1930 | France | 52/713 |
| 599412 | 5/1978 | Switzerland | 52/714 |

*Primary Examiner*—John E. Murtagh
*Assistant Examiner*—Andrew Joseph Rudy
*Attorney, Agent, or Firm*—Darby & Darby

[57] ABSTRACT

Apparatus for providing double coverings or claddings has a stiff support piece shaped to fit in a bottom portion of a corrugation of a pre-existing roof covering. The support piece attaches to subjacent purlins through the pre-existing covering. The support piece has a generally U-shaped section including a base coopertively shaped for being seated in the corrugation with upper edges of the U-shaped section being folded back horizontally so as to provide two seats for engaging an upper purlin. The laterally disposed ends of the seats are raised at right angles to form abutments. An upper purlin is attached to the abutments of the support piece. The upper purlin is a reversed U-shaped metallic section having side wings. The wings have edges folded back horizontally and outwardly.

21 Claims, 8 Drawing Figures

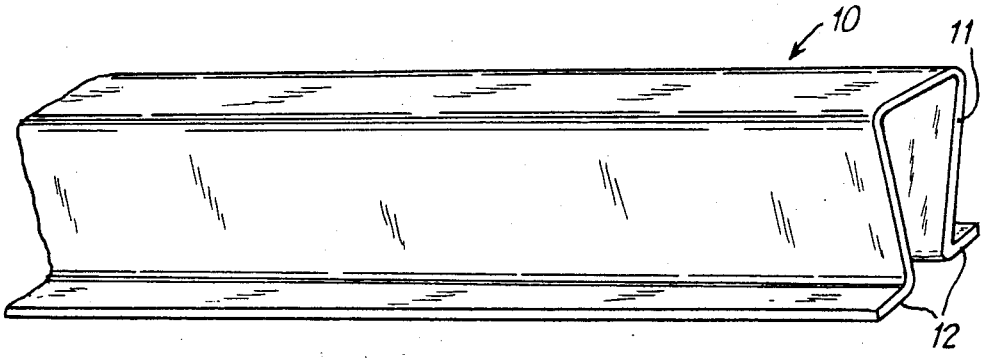
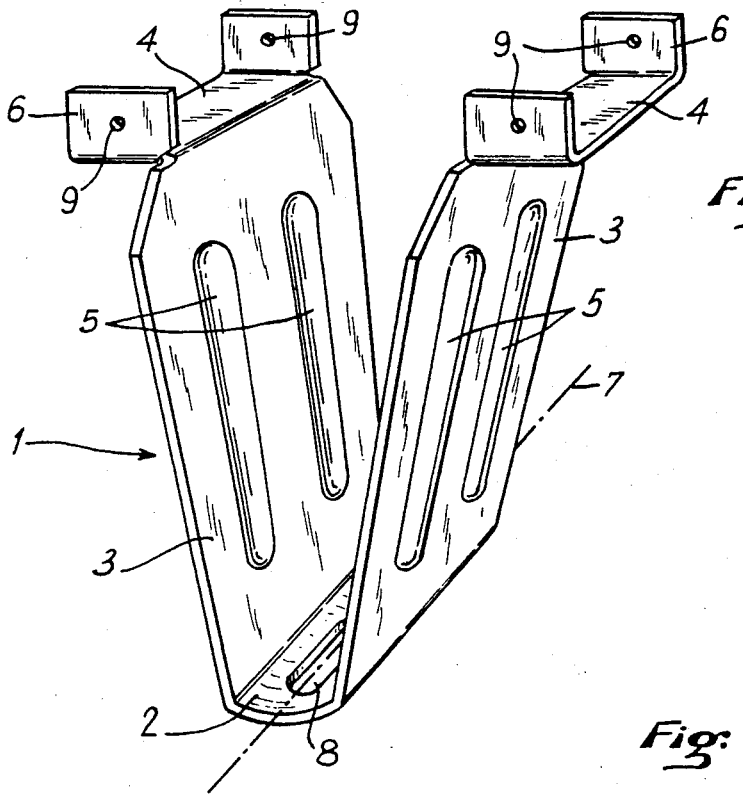
Fig. 1
Fig. 7
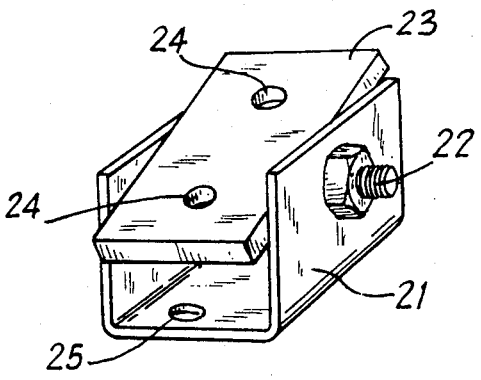

DEVICE FOR PROVIDING DOUBLE COVERINGS OR CLADDINGS, SUPPORT PIECES, SUPPORTS AND PLIERS FOR PUTTING INTO EFFECT SAID DEVICE

FIELD OF THE INVENTION

The invention relates to roofings and claddings. It relates to a device for providing double coverings or claddings.

The need for such double coverings and claddings has been realized ever since the necessity of thermally and acoustically insulating roofings and claddings has been felt in order to spare energy, to provide comfort in the summer and to insulate housing or working premises from the outer acoustic aggressions.

The advantage of double coverings and claddings is that they allow executing the insulating operations directly on existing buildings, already built since years and which had not been designed for receiving insulations. Moreover, they allow restoring existing coverings while the occupants continue living normally in the premises.

BACKGROUND OF THE INVENTION

A method presently used consists in fixing purlins on existing coverings between which is disposed in insulating material, and in fixing on said purlins a new covering.

According to another method also known, staples of U-shaped stirrups are fixed in the bottom of the corrugations, the rafters of the second covering being attached to said staples in order to prevent them from bearing against the corrugation apexes of the first covering.

Said known methods have disadvantages. In the first case, the purlins bearing on the corrugation apexes risk squashing the corrugations, due to the load thus applied at the apex of the deformable profiles. This is paticularly the case for coverings made of fibre-cement plates. On the other hand, the purlin fixation screws are large sized and work in flexion.

In the second case, the staples are not universal, the center distance of the axes of the staple fixation lugs being different according to the covering profile used (fibre-cement plate, corrugated sheet, etc.). Therefore, it is necessary to provide as many different staples as there are profiles currently used, which are presently several hundred in number. Moreover, the staples do not include means providing for the appropriate positioning of the purlins for their fixation, and when the positioning is reached, a drilling of the two parts (purlin and staple) has to be made in order to assemble them, for example with bolts. These drilling operations are very delicate to perform due to the inclination of the roofs.

OBJECTS AND SUMMARY OF THE INVENTION

The invention provides a device remedying the hereabove mentioned disadvantages. To this effect, the device according to the invention comprises a support piece made of a general U-shaped section, the upper edge of the wings of which is folded back horizontally toward the outside for forming two seats, the ends of said seats being raised at a right angle for forming centering and fixation abutments for an upper purlin on said support piece, either by screwing through said abutments or by squeezing said abutments onto the corresponding edges of said purlin.

The dimensions of the support piece are advantageously chosen so that its small base can fit in all the corrugations of roofings generally used, while the height of its flanks is greater than that of the highest profiles generally used.

The pieces according to the invention are fixed in the bottom of the corrugations parallel to the roof incline, directly on a subjacent purlin, through the existing covering plate.

According to a preferential embodiment, the support piece has a trapezoidal cross-section, with its wings diverging slightly outwardly, while the purlin associated therewith has an omega-shaped cross-section.

The invention is also directed to the support piece of the hereabove device, characterized by its general U shape, with its folded back upper edges forming a seat and its abutments.

Moreover, the invention relates to connection pieces for the purlins of the device according to the invention and an inclinable support for the fixation of the support pieces on inferior purlins.

Finally, the invention relates to pliers specially designed for mounting the purlins on the support pieces and the connection of the purlins to each other.

BRIEF DESCRIPTION OF THE DRAWINGS

These various objects as well as other features and advantages of the invention will become more apparent from the hereafter description of preferred embodiments, with reference to the accompanying drawings wherein:

FIG. 1 a perspective view of a purlin support piece according to the invention, with an omega-shaped purlin.

FIG. 7 is a perspective view of an inclinable support for the fixation of the support piece on a non sloping inferior purlin.

DETAILED DESCRIPTION OF THE EMBODIMENTS

Figure 2:
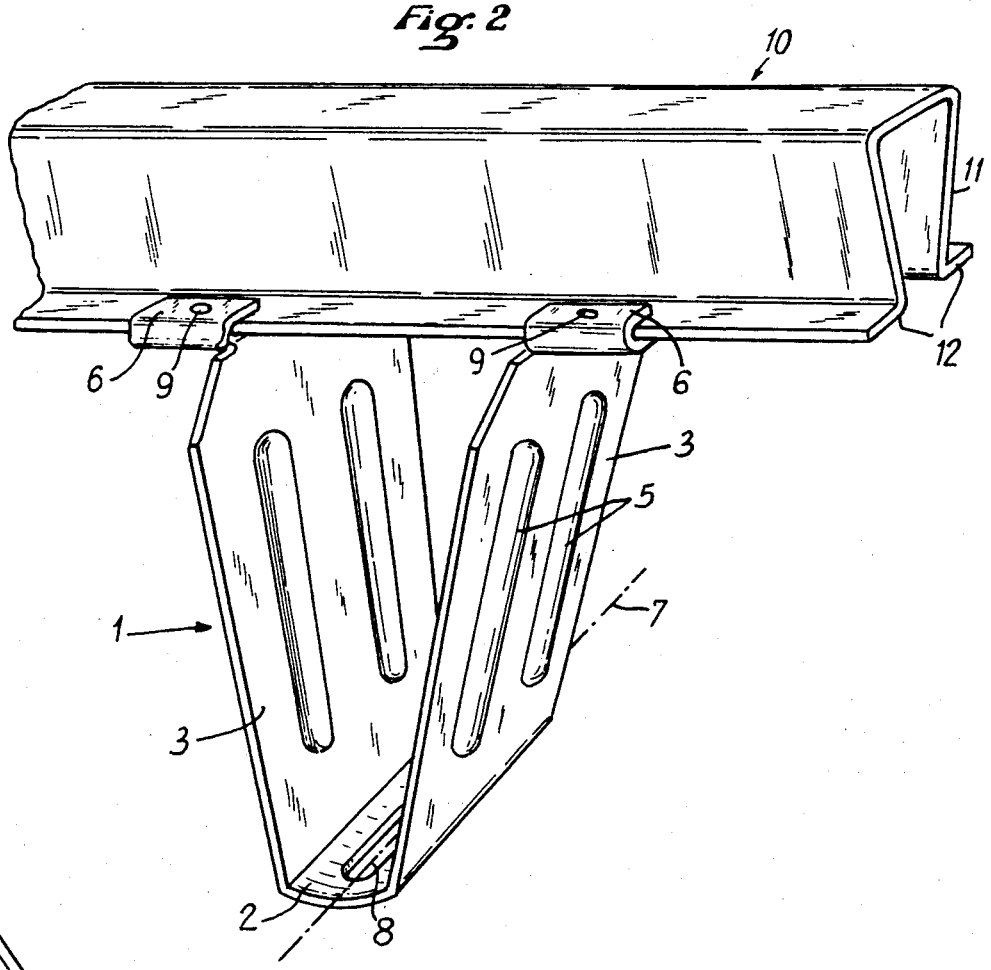
FIG. 2 is a perspective view similar to FIG. 1, the support piece and the omega-shaped purlin being assembled.
Figure 3:
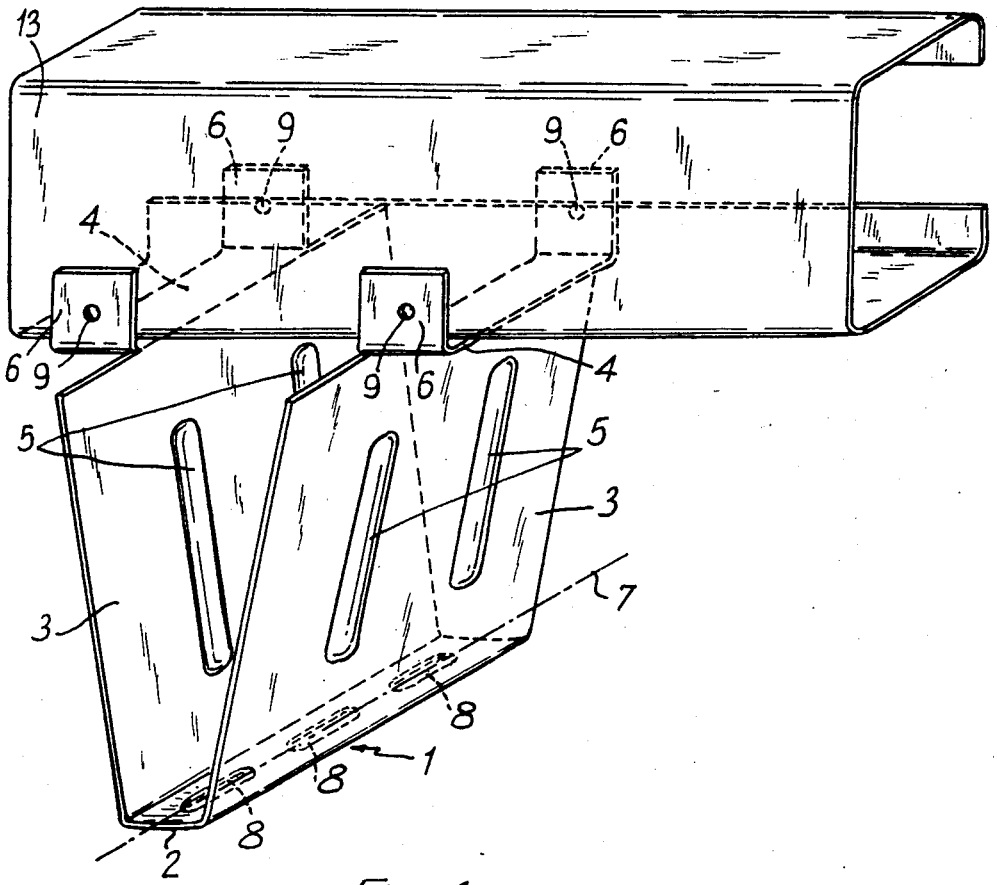
FIG. 3 is a perspective view of the support piece of FIG. 1, with a C-shaped purlin.

The support piece 1 shown in FIGS. 1 to 3 is a generally U-shaped staple provided for bearing via its base 2 in the bottom of the corrugations of the roofing to be restored. Preferably, and as is shown, the support piece has a trapezoidal shape in cross-section, the wings 3 diverging slightly outwardly. The upper edges 4 of wings 3 are folded back horizontally for forming the seat of the purlins, such as purlin 10, which will have to support the new covering.

The height of wings 3 is greater than that of the highest covering profiles, which are currently used. Thus, the purlins carried by pieces 1 which are fixed in the bottom of the corrugations will always be spaced from the corrugation apexes of the existing covering. Therefore, there is no risk for the latter being squashed.

The wings are advantageously provided with reinforcement ribs 5.

The edges 4 are cut along their folding line up to a certain distance on either side of the central portion of said edges and form the abutments standing up at a right angle 6, normal to said folding line, the double function of which is to prevent the sliding of the purlins on pieces 1 in the direction of the inclination of the roofing and to form fixation lugs for said purlins when they are folded back in order to clamp the edges of the latter.

Along the median longitudinal axis 7 of base 2 of the support piece 1 are formed elongated perforations 8 for the setting and fixation of said piece 1 to the pre-existing roofing purlins, through the covering plates.

Likewise, the abutments 6 can be formed with holes 9 for screws, preferably self-cutting, possibly reinforcing the fixation of purlins 10.

Preferably, base 2 of piece 1 is curved for matching the profile of the corrugations on which it has to be fixed. Purlin 10 (FIG. 2) which is to cooperate with the support pieces 1 will generally be of a reversed U-shaped metallic section, the wings 11 of which are provided with edges 12, folded back horizontally and outwardly, on which are folded back the abutments 6 of piece 1.

The assembly formed by the existing purlin, a purlin 10 and the pieces 1 supporting it forms a beam of greatly increased inertia, adapted not only for supporting the weight of the second covering but also for reducing the fatigue of the existing purlin.

In the example shown in FIG. 2, purlin 10 has advantageously an omega-shaped cross-section for forming with piece 1 of trapezoidal cross-section an indeformable triangulation.

FIG. 3 shows another embodiment in which purlin 13 has an opened profile of square cross-section, the side of which is equal to the width of seating 4 of piece 1. In this example, the abutments 6 are simply screwed against the flanks of the purlin, thereby avoiding the folding operation.

Figure 4:
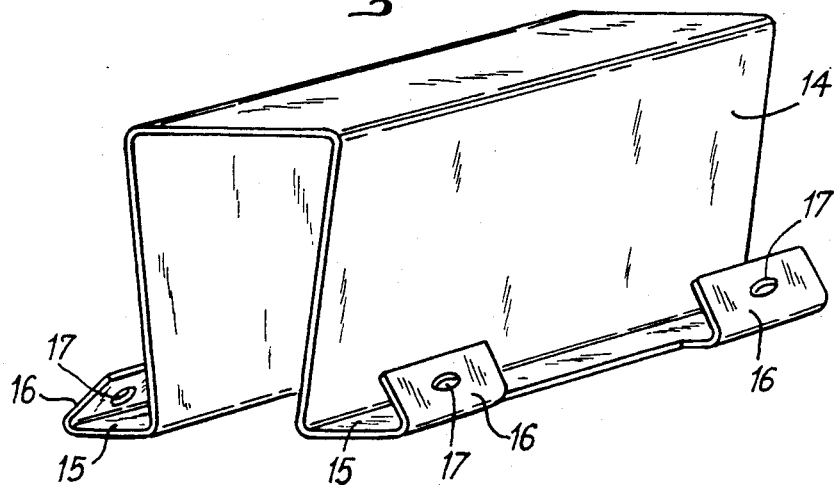
FIG. 4 is a perspective view of a first embodiment of a connection piece for the end to end assembly of two omega-shaped purlins.

FIG. 4 shows a special piece 14 for connecting end to end two omega-shaped purlins. The connection piece 14 has a profile the cross-section of which corresponds to that of the purlins to be connected, here an omega-shaped cross-section, but of slightly less dimensions.

The edges horizontally folded 15 of piece 14 are provided with at least two lugs 16, which are to be folded back onto the outer edges 12 of the omega-shaped purlins 10. Generally, this clamping provides a sufficient fixation.

However, holes 17 can be formed in said lugs, so as to provide a fixation with screws or bolts if need be.

Figure 5:
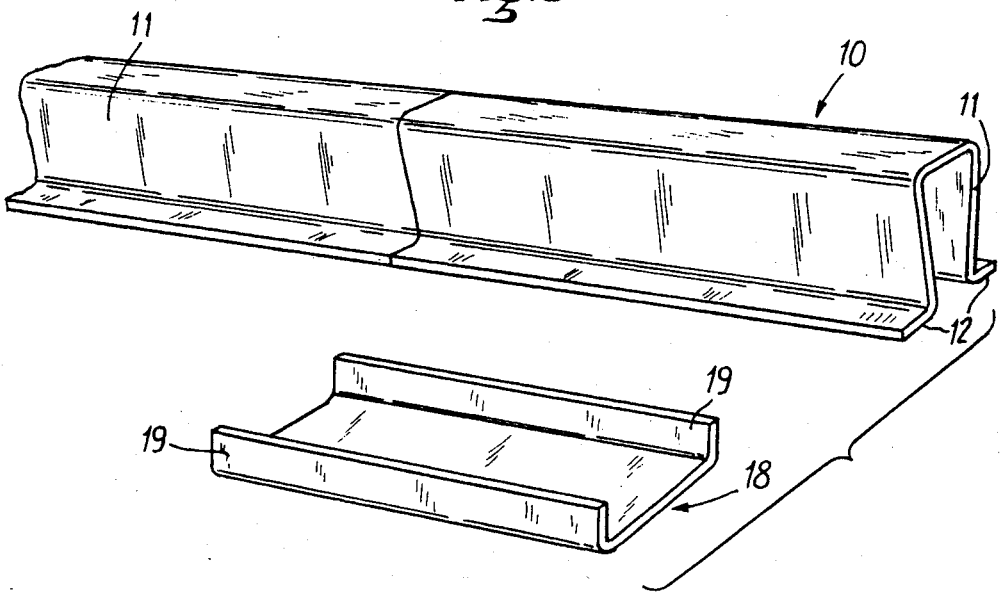
FIG. 5 is a perspective view of another embodiment of a connection piece for the end to end assembly of two omega-shaped purlins.

FIG. 5 shows another connection piece 18, more economical to manufacture and much quicker to install. Said piece 18 is a simple U-shaped fishplate provided with two lugs 19 for stapling piece 18 onto the edges 12 of the purlins 10 to connect, and assisting the centering of said purlins when installing the fishplate.

Figure 6:
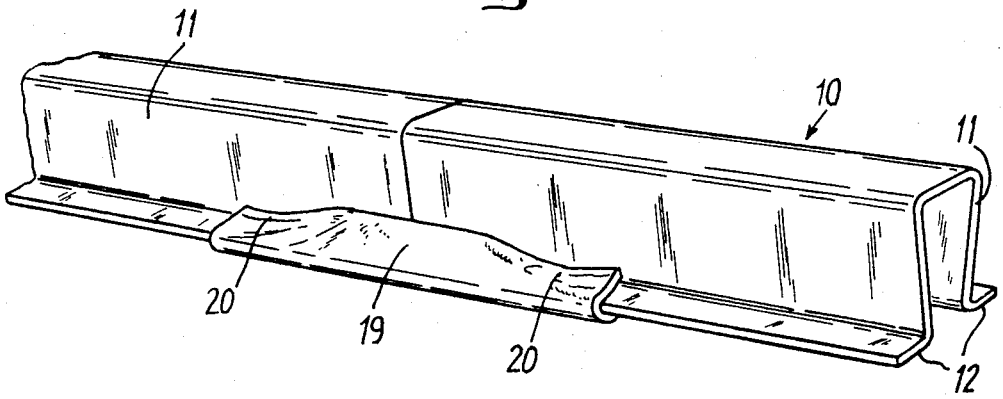
FIG. 6 is a perspective view of the assembly of two omega-shaped purlins by means of the piece of FIG. 5.

An example of a connection by means of said fishplate is shown in perspective in FIG. 6. By folding back the four ends of lugs 19 over a small distance, the fishplate is rigidly connected to the two purlins, but the central portion of the fishplate which is in register with the connection plane between the two purlins is left incompletely folded, thereby reinforcing the inertia of said connection plane. Said stapling to the four corners of fishplate 18 amplifies the clamping effect since the slanting portions 20 of lug 19 which connect the stapled portion to the non folded portion strongly assist the folding and thereby oppose the unclamping of lug 19.

When in an existing roofing the covering plate is not laid flat on the purlin supporting it, as is sometimes the case in the position of the inferior purlins, a wedge has to be interposed, if need be, before installing the support pieces 1, between the covering plate and the purlins supporting it, so that the portion of the covering plate which will be sandwiched between said purlin and the support piece 1 will actually work well in compression.

As an alternative the invention provides fixing on the inferior purlin an inclinable support, such as that shown in FIG. 7. Said support is made of a U-shaped piece 21 through which extends a bolt 22 forming a pivoting axis for an inclinable support 23 formed with two holes 24.

Thereby is obtained a universal connection piece since it can be adapted to all roofings, whatever their angle of inclination, the inclinable support 23 being secured against motion in the appropriate position by simply tightening bolt 22.

Said piece 21 allows omitting the wedges foreseen hereabove, the number of which was important for being adapted to all the roof inclinations which can be encountered in everyday life.

For installing pieces 21, one has to clear the inferior purlin at a corresponding location by forming a slight cut in the covering plate, piece 21 being directly screwed on the inferior purlin by means of a self-cutting screw extending through the holes 25 of the bottom of piece 21.

As already stated, the installation of the omega-shaped purlins 10 on the support pieces 1, as well as the conection between themselves of two omega-shaped purlins, is usually carried out by folding back on the horizontal edge 12 of said purlins abuments 6 of the support piece 1 and/or lugs 19 of fishplate 18.

Figure 8:
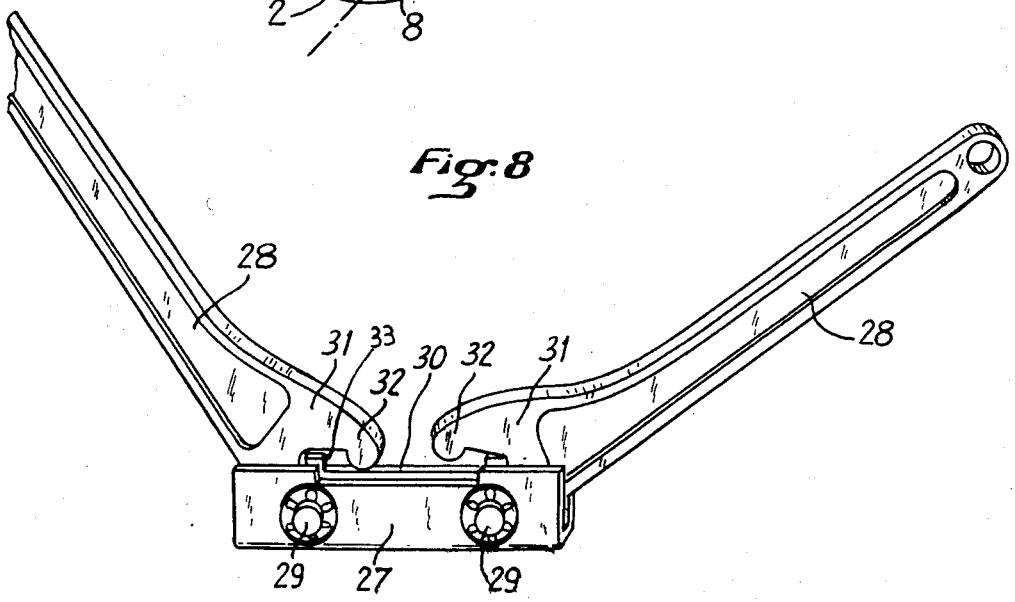
FIG. 8 is a perspective view of a pliers specially designed for mounting the device according to the invention.

In order that such operations can be carried out quickly and efficiently, the invention provides also for the use of a special pliers 26 shown in perspective in FIG. 8.

Said pliers is made of a cage 27 in which two antagonistic levers 28 are mounted for freely pivoting about two axes 29, spaced apart from each other in the same plane.

Cage 27 is extending outwardly, beyond the articulation axes 29 of levers 28, for forming an abutment maintaining said levers in alignment with each other in the opened position of the pliers.

Between the two levers 28, the pliers includes a supporting surface 30, forming a centering housing with upstanding edges 33, for cooperating with the seats 4 of the support pieces 1 and the bottom of the fishplates 18 during the installation operations.

Adjacent their articulation points to cage 27, levers 28 are provided with fingers 31, forming push-pieces acting on the abutments 6 of pieces 1 and the lugs 19 of fishplate 18 when using pliers 26.

Preferably, the end 32 of fingers 31 is rounded in shape.

The pliers 26 thus formed allows grasping simultaneously and with a single movement the two sides of pieces 1 and of a fishplate 18, housing 30–33 having provided a self-centering of the piece.

The blocking of the levers in alignment when in their opened position allows the setting in position with a single hand of the pliers in a working position.

We claim:

1. A device for providing double coverings or claddings comprising:

a stiff support piece adapted to be fixed in a bottom portion of a corrugation of a pre-existing roof covering, said support piece adapted to be fixed to subjacent purlins through said covering, said support piece having a generally U-shaped section including a base cooperatively shaped for being fixed in said bottom of said corrugation, with upper edges of said U-shaped section being folded back horizontally so as to provide two seats, with laterally disposed ends of said seats raised at a right angle to said seats for forming abutments, an upper purlin fixed to said abutments of said support piece, wherein said upper purlin is a reversed U-shaped metallic section having side wings, said wings having edges folded back horizontally and outwardly.

2. A device according to claim 1, wherein the support piece is trapezoidal in cross-section, its wings diverging slightly outwardly.

3. The device according to claim 1, wherein said abutments are in clamped engagement to said upper purlin.

4. A device according to claim 1, wherein said upper purlin is an omega-shaped section.

5. A device according to claim 1, wherein said purlin is an opened square-shaped section.

6. The device according to claim 1, wherein said abutments are fixed to said upper purlin by screws.

7. A support piece according to claim 6, wherein said base is slightly flat so that the support piece has a trapezoidal shape with wings diverging outwardly.

8. A support piece according to claim 1 or 7, wherein said abutments have holes for connecting said support piece to a purlin.

9. A support piece according to claim 8, wherein said base has perforations for connecting said support piece to piece to a subjacent purlin.

10. A support piece according to claim 9, wherein said base has a curved profile shaped so as to match a profile of said bottom of said corrugations of an existing roof.

11. The device according to claim 6 further comprising a purlin connection piece, wherein said piece has a cross-section corresponding to and slightly smaller than that of said purlins to be connected, said purlin connection piece having wings with at least two movable lugs positioned so as to be folded back on outer edges of said purlins.

12. The device according to claim 1 further comprising a purlin connection piece, wherein said purlin connection piece is a U-shaped fishplate having two wings adapted to be folded back at least partly on the outer edges of said purlins.

13. The device according to claim 1, further comprising an adjustable support for connecting said support piece to a subjacent purlin, wherein said adjustable support is a U-shaped piece having wings through which extends a bolt, said bolt forming a pivoting axis for an inclinable support ramp having two holes therein, the only adjustment of said adjustable support being rotation on said pivoting axis.

14. A structure for providing a second covering on a roof, said roof having a first covering supported by a plurality of subjacent purlins, the structure comprising, in combination:

a plurality of generally U-shaped support pieces positioned on top of said first covering, each fastened to one of said subjacent purlins, said first covering being substantially between said subjacent purlin and support piece, respectively; and a plurality of upper purlins fastened to upper ends of said support pieces, said structure of the fastened subjacent purlins, said support pieces, and said upper purlins constituting support means for said second roof covering;

each of said support pieces further comprising:

a U-shaped section having a base portion shaped so as to generally conform to a trough bottom of a corrugated roof covering;

horizontal seats integrally connected to said upper ends of said U-shaped section for supporting an upper purlin, said seats having laterally disposed ends bent upwardly so as to provide abutments for fixedly retaining said upper purlin in position.

15. The structure of claim 14, wherein each said upper purlin is an elongate member having an inverted, generally U-shaped cross section, with the lower edges of said inverted U-shaped section bent outwardly and substantially horizontally.

16. The structure of claim 15, wherein said support piece abutments are further bent downwardly toward said seats, so as to retain said upper purlin lower edges therebetween, in clamped engagement.

17. The structure of claim 14, wherein each said upper purlin is an elongate member having upper and side sections in a generally square cross section, open along the lower side of said square.

18. The structure of claim 17, wherein said abutments are fastened to said side sections of said upper purlins.

19. The structure of claim 14, wherein each said upper purlin is an elongate member having an inverted, generally omega-shaped cross section, with the lower edges of said inverted omega-shaped section bent outwardly and substantially horizontally.

20. The structure of claim 19, wherein said support piece abutments are further bent downwardly toward said seats, so as to retain said upper purlin lower edges therebetween, in clamped engagement.

21. The structure of claim 14, wherein said support pieces have a trapezoidal cross-section, said upper ends diverging slightly.

* * * * *